US006552686B2

(12) United States Patent
Ollikainen et al.

(10) Patent No.: US 6,552,686 B2
(45) Date of Patent: Apr. 22, 2003

(54) INTERNAL MULTI-BAND ANTENNA WITH IMPROVED RADIATION EFFICIENCY

(75) Inventors: Jani Ollikainen, Hki (FI); Antero Lehtola, Turku (FI)

(73) Assignee: Nokia Corporation, Espoo (FI)

( * ) Notice: Subject to any disclaimer, the term of this patent is extended or adjusted under 35 U.S.C. 154(b) by 0 days.

(21) Appl. No.: 09/953,353

(22) Filed: Sep. 14, 2001

(65) Prior Publication Data

US 2003/0052824 A1 Mar. 20, 2003

(51) Int. Cl.[7] ..... H01Q 1/38
(52) U.S. Cl. ..... 343/700 MS; 343/702
(58) Field of Search ..... 343/700 M, 702, 343/846, 848; 455/90

(56) References Cited

U.S. PATENT DOCUMENTS

| | | | | |
|---|---|---|---|---|
| 5,926,139 A | | 7/1999 | Korisch | 343/702 |
| 6,140,966 A | | 10/2000 | Pankinaho | 343/700 |
| 6,348,892 B1 | * | 2/2002 | Annamaa et al. | 343/700 MS |
| 6,380,905 B1 | * | 4/2002 | Annamaa et al. | 343/700 MS |
| 6,404,394 B1 | * | 6/2002 | Hill | 343/700 MS |
| 6,407,715 B1 | * | 6/2002 | Chen | 343/700 MS |
| 6,408,190 B1 | * | 6/2002 | Ying | 343/700 MS |

FOREIGN PATENT DOCUMENTS

| | | | |
|---|---|---|---|
| EP | 0642189 | 3/1995 | H01Q/1/24 |
| EP | 0757405 | 2/1997 | H01Q/9/04 |
| EP | 0851533 | 7/1998 | H01Q/9/42 |
| EP | 0997974 | 5/2000 | H01Q/9/04 |
| EP | 1067627 | 1/2001 | H01Q/9/04 |
| WO | 0133665 | 5/2001 | H01Q/1/24 |

OTHER PUBLICATIONS

Patent Abstracts of Japan, "Multi–Frequency Antenna", Publ. No. 2000–068736, Published Mar. 3, 2000.

Dual–Frequency Planar Inverted–F Antenna, Liu et al., IEEE Transactions on Antennas and Propagation, vol. 45, No. 10, Oct. 1997, pp. 1451–1458.

Triple–Band Planar Inverted F Antenna, Song et al., IEEE Antennas and Propagation International Symposium Digest, vol. 2, Orlando, Florida, Jul. 11–16, 1999, pp. 908–911.

* cited by examiner

*Primary Examiner*—Tan Ho
(74) *Attorney, Agent, or Firm*—Ware, Fressola, Van der Sluys & Adolphson LLP

(57) ABSTRACT

A radio antenna including a first shorted patch having a first resonance frequency (GSM1800), a second shorted patch having a second resonance frequency (E-GSM) connected to the first shorted patch for sharing a feed point, and a third shorted patch having a third resonance frequency (GSM1900) located adjacent to the second shorted patch. The second shorted patch has an extended portion surrounding at least two sides of the first shorted patch, leaving a gap therebetween. The third shorted patch serves as a parasitic patch to increase the bandwidth of the second shorted patch. Part of the extended portion of the second shorted patch is extended beyond the top edge of the ground plane to which the patches are grounded.

19 Claims, 3 Drawing Sheets

INTERNAL MULTI-BAND ANTENNA WITH IMPROVED RADIATION EFFICIENCY

FIELD OF THE INVENTION

The present invention relates generally to a radio antenna and, more specifically, to an internal multi-band antenna for use in a hand-held telecommunication device, such as a mobile phone.

BACKGROUND OF THE INVENTION

The development of small antennas for mobile phones has recently received much attention due to size reduction of the handsets, requirements to keep the amount of radio-frequency (RF) power absorbed by a user below a certain level regardless of the handset size, and introduction of multi-mode phones. It would be advantageous, desirable and even necessary to provide internal multi-band antennas to be disposed inside a handset body, and these antennas should be capable of operating in multiple system such as E-GMS900 (880 MHz–960 MHz), GSM1800 (1710 MHz–1880 MHz), and PCS1900 (1859 MHz–1990 MHz). Shorted patch antennas, or planar inverted-F antennas (PIFAs), have been used to provide two or more resonance frequencies. For example, Liu et al. (Dual-frequency planar inverted-F antenna, IEEE Transaction on Antennas and Propagation, Vol.45, No.10, October 1997, pp. 1451–1458) discloses a dual-band PIFA; Pankinaho (U.S. Pat. No. 6,140,966) discloses a double-resonance antenna structure for several frequency ranges, which can be used as an internal antenna for a mobile phone; Isohatala et al. (EP 0997 974 A1)discloses a planar antenna having a relatively low specific absorption rate (SAR) value; and Song et al. (Triple-band planar inverted-F antenna, IEEE Antennas and Propagation International Symposium Digest, Vol.2, Orlando, Fla., Jul. 11–16, 1999, pp.908–911) discloses a triple-band PIFA.

Currently, the antenna is one of the largest parts in a mobile phone. In order to fit more antenna elements with acceptable performance in the available space, there is an ongoing effort to reduce their physical size. As the size of the mobile phone decreases, the radiation efficiency of traditional small internal handset antennas also decreases, particularly in an antenna system that has wavelengths corresponding to a resonance frequency below 1 GHz. The reduction in radiation efficiency is due to the fact that the radiation resistance of the antenna is very small compared with the radiation resistance of the chassis. This means that a substantial part of the radiation is caused by the chassis currents and a relatively small part of radiation is attributable to the antenna. Furthermore, when the ground plane of a planar antenna in the handset is sufficiently small, the reactive near fields of the antenna surround the ground plane. Consequently, the currents on the ground plane are substantially uniform on both sides of the ground plane. This phenomenon becomes noticeable when the size of the ground plane in the handset is smaller than one-third the resonance wavelength. Locating the internal antenna on the back of the handset does not sufficiently improve the specific absorption rate (SAR) characteristics caused by the ground-plane currents of the antenna. With internal antennas, the currents on the antenna element yield only moderate SAR values to the user's head. The relationship between the resonance wavelength and the size of the ground plane renders it difficult to design an internal antenna with high efficiency, especially for a GSM900 system. However, with a GSM1800 system, the resonance wavelength is usually smaller than the size of the ground plane.

It is advantageous and desirable to provide a three-band internal radio antenna for use in a mobile phone capable of operating in multiple systems such as E-GSM900, GSM1800 and PCS1900. The antenna is simple to produce and, at the same time, the SAR characteristics of the antenna are also improved.

SUMMARY OF THE INVENTION

According to first aspect of the present invention, a multi-band radio antenna structure for use in a hand-held telecommunication device comprises:

a ground plane;

a first planar radiating element formed of a first electrically conducting area having a first resonance frequency, wherein the first planar radiating element has a grounding point and a feed point for feeding adjacent to the ground point;

a second planar radiating element formed of a second electrically conducting area having a second resonance frequency substantially lower than the first resonance frequency, wherein the second electrically conducting area has a grounding end connected to the first electrically conducting area adjacent to the grounding point of the first planar radiating element, and an open end surrounding at least two sides of the first electrically conducting area, leaving a gap between the second electrically conducting area and the surrounded sides of the first electrically conducting area; and a third radiating element formed of a third electrically conducting area adjacent to the second planar radiating element having a third resonance frequency generally higher than the first resonance frequency, wherein the third electrically conducting area has a further grounding point.

Preferably, the first, second and third electrically conductive areas are co-located on a common plane.

Preferably, one section of the open end of the second electrically conducting area is extended beyond an edge of the ground plane.

According to the present invention, the first resonance frequency is substantially in a frequency range of 1710 MHz to 1880 MHz, the second resonance frequency is substantially in a frequency range of 880 MHz to 960 MHz, and the third resonance frequency is substantially in a frequency range of 1850 MHz to 1990 MHz. The third resonance frequency, in general, is higher than the first frequency, but their frequency ranges have an overlapping section.

According to the second aspect of the present invention, a hand-held telecommunication device capable of operating at multi-band frequencies, said hand-held telecommunication device comprises:

a housing including a front portion and a back cover;

a chassis disposed in the housing between the front portion and the back cover, wherein the chassis has a back side facing the back cover and an opposing back side having a ground plane, and wherein the ground plane has a top edge located adjacent to a top end of the housing; and an antenna structure comprising:

a first planar radiating element formed of a first electrically conducting area having a first resonance frequency, wherein the first planar radiating element has a grounding point connected to the ground plane and a feed point for feeding adjacent to the ground point;

a second planar radiating element formed of a second electrically conducting area having a second resonance frequency substantially lower than the first resonance frequency, wherein the second electrically conducting area has a grounding end connected to the first electrically conducting area adjacent to the grounding point of the first planar radiating element and an open end surrounding at least two sides of the first electrically conducting area, leaving a gap between the second electrically conducting area and the surrounded sides of the first electrically conducting area, and wherein the open end has an extended portion adjacent to the top end of the housing and extended beyond the top edge of the ground plane.

Preferably, the antenna structure further includes a third radiating element formed of a third electrically conducting area adjacent to the second planar radiating element having a third resonance frequency generally higher than the first resonance frequency, wherein the third electrically conducting area has a further grounding point.

Preferably, the first, second and third electrically conductive areas are co-located on a common plane.

According to the third aspect of the present invention, a method of improving radiating efficiency and characteristics of a multi-band antenna structure in a hand-held telecommunication device, wherein the hand-held telecommunication device has a housing including a front portion and a back cover;

a chassis disposed in the housing between the front portion and the back cover, wherein the chassis has a back side facing the back cover and an opposing front side having a ground plane, and wherein the ground plane has a top edge located adjacent to a top section of the housing; and an antenna structure comprising:

at least two planar radiating elements, wherein the first planar radiating element is formed of a first electrically conducting area having a first resonance frequency, and wherein the first planar radiating element has a grounding point connected to the ground plane and a feed point for feeding adjacent to the ground point; and the second planar radiating element is formed of a second electrically conducting area having a second resonance frequency substantially lower than the first resonance frequency, wherein the second electrically conducting area has a grounding end connected to the first electrically conducting area adjacent to the grounding point of the first planar radiating element and an open end surrounding at least two sides of the first electrically conducting area, leaving a gap between the second electrically conducting area and the surrounded sides of the first electrically conducting area, and the open end has an extended portion adjacent to the top end of the housing. The method comprises the steps of:

disposing the ground plane away from the top end of the housing for providing a further gap between the top edge of the ground plane and the top end of the housing; and disposing the antenna on the chassis such that the extended portion of the open end of the second electrically conducting area is extended beyond the top edge of the ground plane over the further gap between the top edge of the ground plane and the top end of the housing.

Preferably, the antenna structure further includes a third radiating element formed of a third electrically conducting area adjacent to the second planar radiating element having a third resonance frequency generally higher than the first resonance frequency, wherein the third electrically conducting area has a further grounding point.

The present invention will become apparent upon reading the description taking in conjunction with FIGS. 1 and 3.

DETAILED DESCRIPTION

Figure 1:
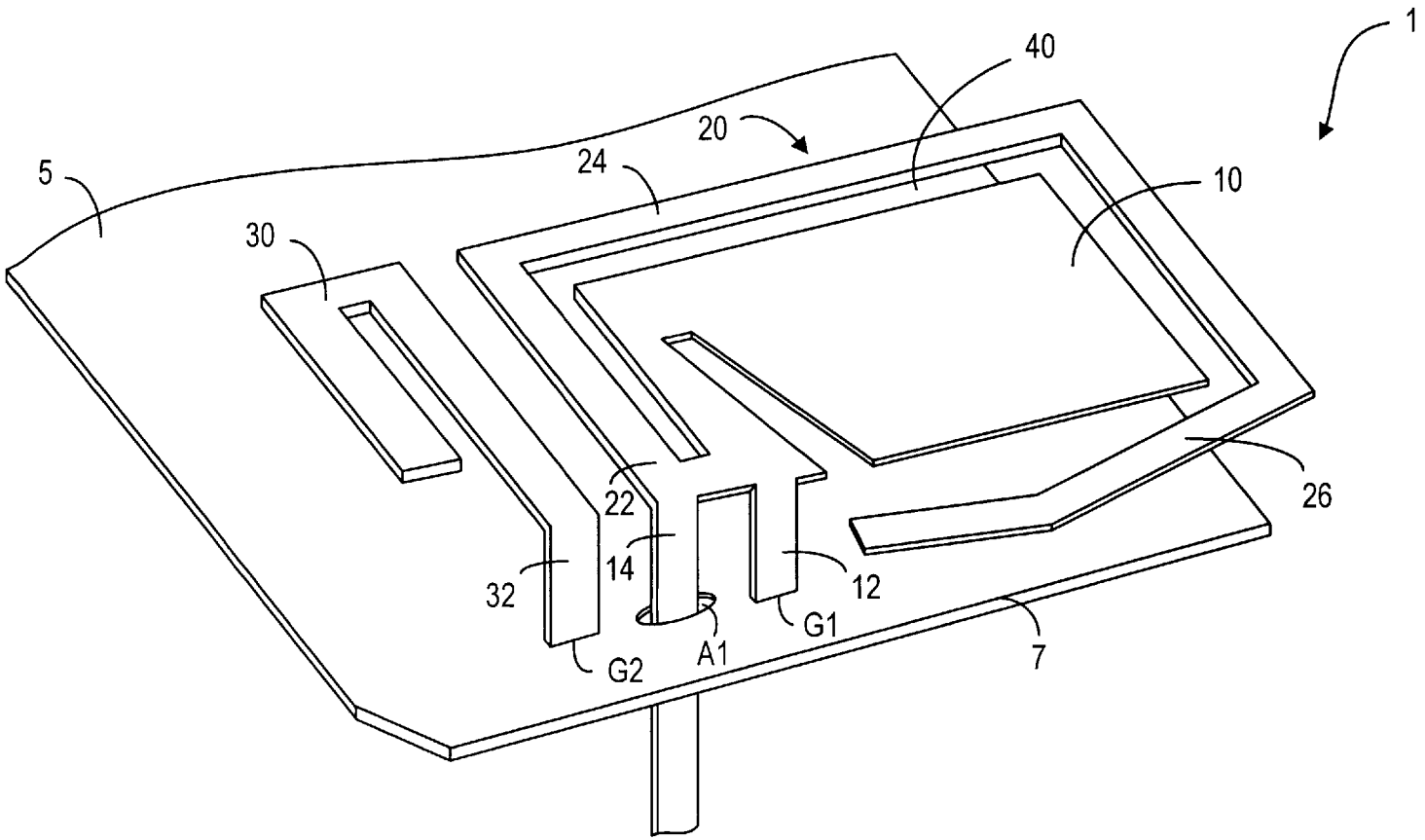
FIG. 1 is an isometric view illustrating the radiating elements of the multi-band antenna structure, according to the present invention.

FIG. 1 shows the multi-band antenna 1, according to the present invention. As shown, the antenna structure 1 has a first radiating element 10, a second radiation element 20 and a third radiating element 30. The first radiating element 10 is substantially a planar electrically conducting area having a grounding end 12 for grounding the first radiating element 10 to a ground plane 5 at a grounding point G1. As such, the first radiating element 10 is a short-circuited patch having a first resonance frequency. Preferably, the first resonance frequency is substantially in the range of 1710 MHz to 1880 MHz. Adjacent to the grounding end 12, a feed line 14 is provided to the first radiating element 10 for feeding. The second radiating element 20 is substantially a strip of planar, electrically conducting area having a grounding end 22 connected to the first radiating element 10 near the grounding end 12 thereof. As such, the second radiating element 20 is a short-circuited patch having a second resonance frequency and, at the same time, the second radiating element 20 can share the feed line 14 for feeding. Preferably, the second resonance frequency is in the frequency range of 880 MHz to 960 MHz. The second radiating element 20 also has an open end 24 surrounding the first radiating element 10, leaving a gap 40 therebetween. The third radiating element 30 is physically separated from the first and the second radiating elements 10, 20. As shown, the third radiating element 30 is substantially a planar electrically conducting element having a grounding end 32 for grounding the third radiating element 30 to the ground plane 5 at a ground point G2. As such, the third radiating element 30 is a short-circuited patch having a third resonance frequency. Preferably, the third resonance frequency is in the frequency range of 1850 MHz to 1990 MHz.

Figure 2:
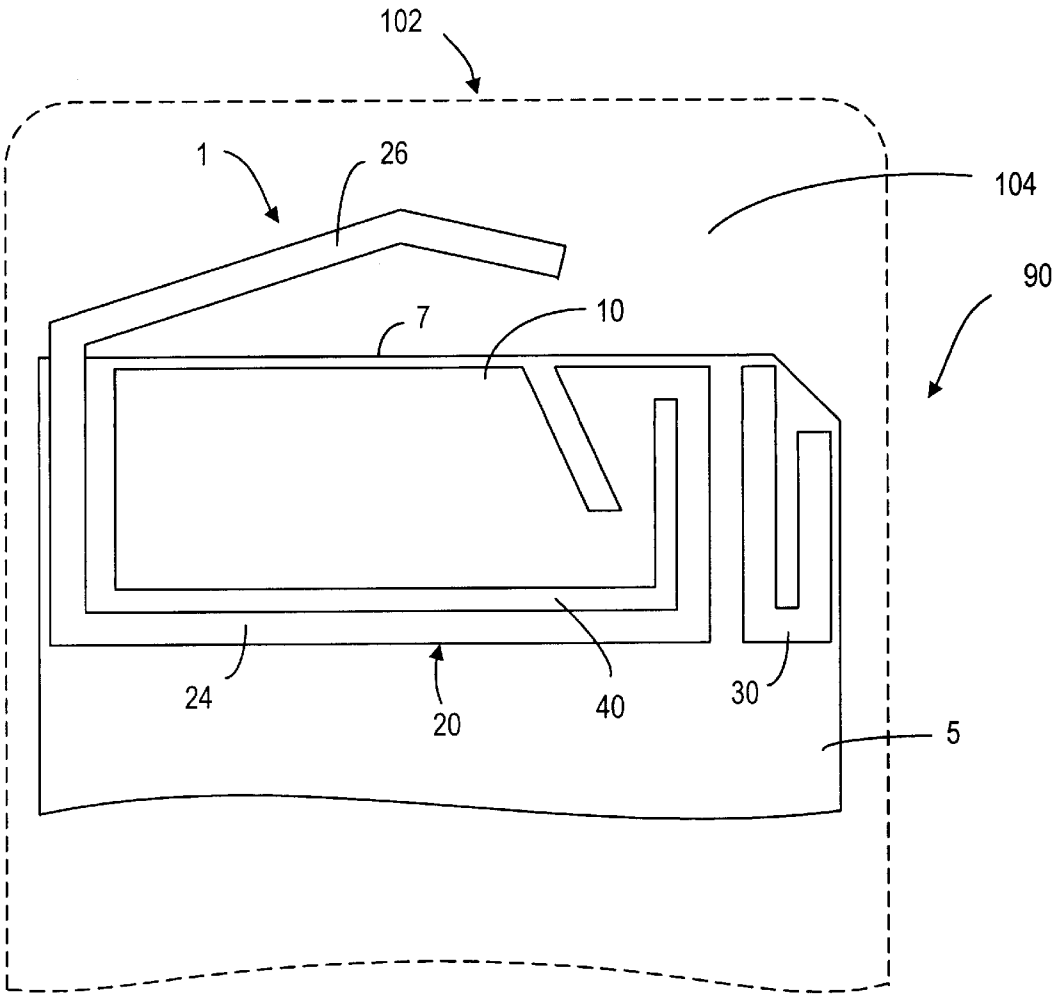
FIG. 2 is a top view illustrating the second radiating element in relation to the ground plane.
Figure 3:
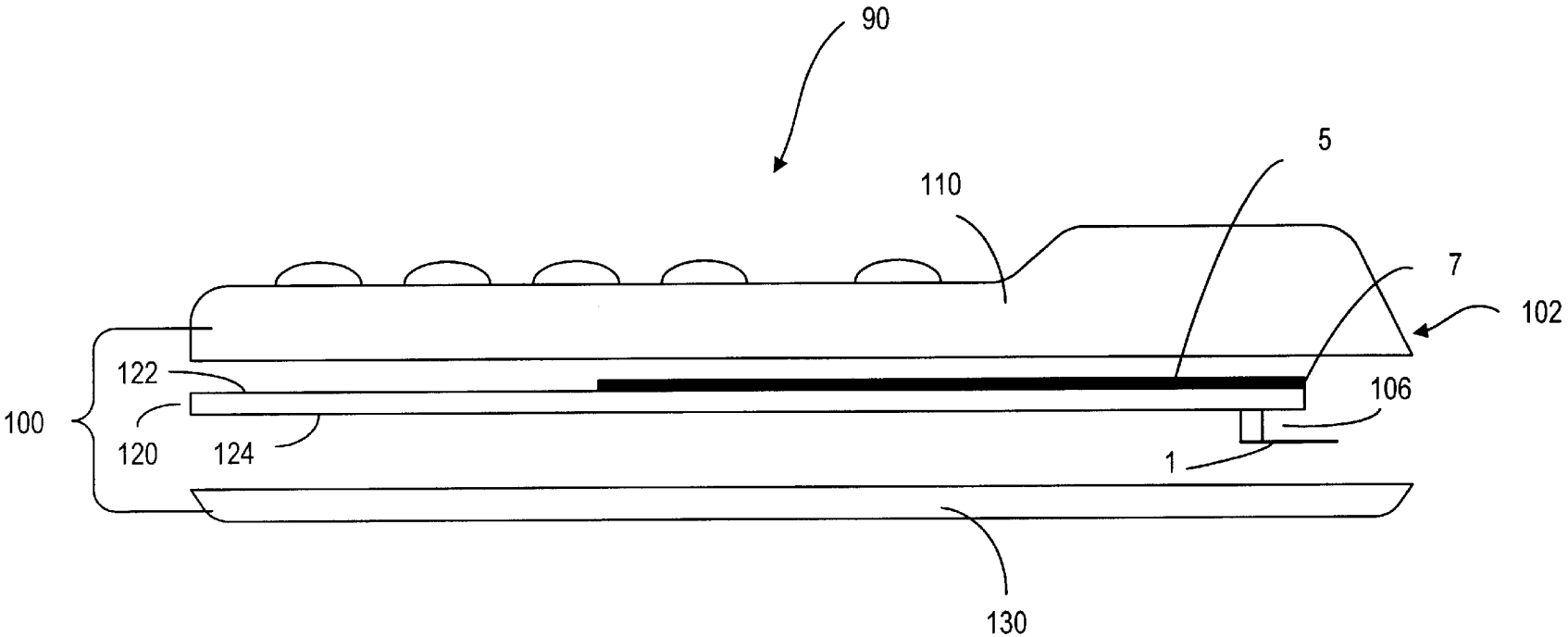
FIG. 3 is an exploded view illustrating the preferred location of the antenna, according to the present invention, in a mobile phone.

Preferably, the antenna 1 is located near the top end 102 of a hand-held telecommunication device, such as a mobile phone 90, as shown in FIGS. 2 and 3. As shown in FIG. 3, the mobile phone 90 includes a housing 100 having a front portion 110 and a back cover 130, and a chassis 120 disposed between the front portion 110 and the back cover 130. The chassis 120 has a back side 124 facing the back cover and an opposing front side 122 for disposing the ground plane 5. The ground plane 5 is disposed away from the top end 102 of the housing 100 for leaving a gap 104 (FIG. 2) between the top edge 7 of the ground plane 5 and the top end 102 of the housing 100. When a user uses the mobile phone 90, the user holds the mobile phone 90 in an upright position such that top end 102 of the housing 100 is near the ear of the user with the front portion 110 facing the user's head.

As shown in FIG. 2, the open end 24 of the second radiating element 20 has an extended portion 26, which is extended beyond the top edge 7 of the ground plane 5. As such, the current maximum of the patch currents of the antenna 1 do not yield a local specific absorption rate (SAR) maximum at the top of the mobile phone. Accordingly, an optimization between the radiation efficiency of the antenna 1 and local SAR value can be achieved. In this way, the coupling between the radiating element 20 of the antenna 1 and the ground plane 5 can be reduced. Furthermore, the radiation from the current maximum of the radiating element 20, which is known to cause higher local SAR values, is behind the ground plane 5. Thus, the radiation resistance of the antenna 1 is increased. Consequently, a substantial part of the total radiation of the mobile phone comes from the antenna 1, and not from the current of the chassis 120 (FIG. 3). By placing the first radiating element well above the ground plane and away from the edges of the ground plane, the directivity of the mobile phone radiation can be improved. As shown in FIG. 3, a sufficient space 106 is provided between the first radiating element 10 (see FIG. 1) and the ground plane 5.

The directivity improvement method, as described hereinabove, can be applied to traditional dual-band antennas where only one higher band patch is used. When the higher band patch is used and the user's hand covers the internal antenna element, this causes serious detuning of the resonance frequency and reduction in the antenna efficiency. This is known as a hand effect. Using the short-circuited third radiating element as a parasitic patch, the parasitic resonance and the resonance from the first radiating element are separated from each other on the end of the housing. As such, the influence of the hand effect on the antenna performance can be reduced because it is unlikely that the user's hand covers both the parasite patch and the second radiating element at the same time.

As shown in FIG. 1, all the radiating elements 10, 20, 30 are located substantially on a common plane. As such, the radiating elements 10, 20 and 30 can be formed from the same electrically conducting layer. For example, they can be etched out of an electronic layer on a substrate. However, the radiating elements 10, 20 and 30 are not necessarily located on the same plane. For example, it is possible that only two of the three radiating elements are located on a common plane, or each of them is located on a different plane. Moreover, each of the radiating elements can be folded or bent such that they can be located on more than one plane. Furthermore, the first, second and third frequencies are disclosed as being in the frequency ranges of 1710 MHz–1880 MHz, 880 MHz–960 MHz and 1859 MHz–1990 MHz, respectively. However, the resonance frequencies can be lower or higher than the frequencies in the respective ranges, depending on the size and geometry of each shorted patch.

Thus, although the invention has been described with respect to a preferred embodiment thereof, it will be understood by those skilled in the art that the foregoing and various other changes, omissions and deviations in the form and detail thereof may be made without departing from the spirit and scope of this invention.

What is claimed is:

1. A multi-band radio antenna structure for use in a hand-held telecommunication device, comprising:

a ground plane;

a first planar radiating element formed of a first electrically conducting area having a first resonance frequency, wherein the first planar radiating element has a grounding point connected to the ground plane and a feed point for feeding adjacent to the grounding point, and wherein the first electrically conducting area is positioned adjacent to a first portion of the ground plane;

a second planar radiating element formed of a second electrically conducting area having a second resonance frequency substantially lower than the first resonance frequency, wherein the second electrically conducting area has a grounding end connected to the first electrically conducting area adjacent to the grounding point of the first planar radiating element, and an open end surrounding at least two sides of the first electrically conducting area, leaving a gap between the second electrically conducting area and the surrounded sides of the first electrically conducting area, and wherein the second electrically conducting area is positioned adjacent to a second portion of the ground plane; and a third radiating element formed of a third electrically conducting area adjacent to the second planar radiating element having a third resonance frequency different from the first resonance frequency, wherein the third radiating element has a further grounding point different from the grounding point of the first planar radiating element, and wherein the third electrically conducting area is positioned adjacent to a third portion of the ground plane different from the first and second portions of the ground plane.

2. The multi-band radio antenna structure of claim 1, wherein the first, second and third electrically conductive areas are co-located on a common plane.

3. The multi-band radio antenna structure of claim 1, wherein the second resonance frequency is substantially in a frequency range of 880 MHz to 960 MHz.

4. The multi-band radio antenna structure of claim 1, wherein the first resonance frequency is substantially in a frequency range of 1710 MHz to 1880 MHz.

5. The multi-band radio antenna structure of claim 1, wherein the third resonance frequency is substantially in a frequency range of 1850 MHz to 1990 MHz.

6. The multi-band radio antenna structure of claim 1, wherein the third resonance frequency is higher than the first resonance frequency.

7. The multi-band radio antenna structure of claim 1, wherein the third resonance frequency is lower than the first resonance frequency.

8. A multi-band radio antenna structure for use in a hand-held telecommunication device, comprising:

a ground plane;

a first planar radiating element formed of a first electrically conducting area having a first resonance frequency, wherein the first planar radiating element has a grounding point and a feed point for feeding adjacent to the grounding point a second planar radiating element formed of a second electrically conducting area having a second resonance frequency substantially lower than the first resonance frequency, wherein the second electrically conducting area has a grounding end connected to the first electrically conducting area adjacent to the grounding point of the first planar radiating element, and an open end surrounding at least two sides of the first electrically conducting area, leaving a gap between the second electrically conducting area and the surrounded sides of the first electrically conducting area; and a third radiating element formed of a third electrically conducting area adjacent to the second planar radiating element having a third resonance frequency generally higher than the first resonance frequency, wherein the third electrically conducting area has a further grounding point, wherein one section of the open end of the second electrically conducting area is extended beyond an edge of the ground plane.

9. A hand-held telecommunication device capable of operating at multi-band frequencies, said hand-held telecommunication device comprises:

a housing including a front portion and a back cover;

a chassis disposed in the housing between the front portion and the back cover, wherein the chassis has a back side facing the back cover and an opposing front side having a ground plane; and an antenna structure comprising:

a first planner radiating element formed of a first electrically conducting area having a first resonance frequency, wherein the first planar radiating element has a grounding point connected to the ground plane, and a feed point for feeding adjacent to the grounding point, and wherein the first electrically conducting area is positioned adjacent to a first portion of the ground plane;

a second planar radiating element formed of a second electrically conducting area having a second resonance frequency substantially lower than the first resonance frequency, wherein the second electrically conducting area has a grounding end connected to the first electrically conducting area adjacent to the grounding point of the first planar radiating element, and an open end surrounding at least two sides of the first electrically conducting area, leaving a gap between the second electrically conducting area and the surrounded sides of the first electrically conducting area, and wherein the second electrically conducting area is positioned adjacent to a second portion of the ground plane; and a third radiating element formed of a third electrically conducting area adjacent to the second planar radiating element having a third resonance frequency different from the first resonance frequency, wherein the third radiating element has a further grounding point different from the grounding point of the first planar radiating element, and wherein the third electrically conducting area is positioned adjacent to a third portion of the ground plane different from the first and second portions of the ground plane.

10. The hand-held telecommunication device of claim 9, the first, second and third electrically conductive areas are co-located on a common plane.

11. The hand-held telecommunication device of claim 9, wherein the second resonance frequency is substantially in a frequency range of 880 MHz to 960 MHz.

12. The hand-held telecommunication device of claim 9, wherein the first resonance frequency is substantially in a frequency range of 1710 MHz to 1880 MHz.

13. The hand-held telecommunication device of claim 9, wherein the third resonance frequency is substantially in a frequency range of 1850 MHz to 1990 MHz.

14. The hand-held electronic device of claim 9, wherein the third resonance frequency is higher than the first resonance frequency.

15. The hand-held electronic device of claim 9, wherein the third resonance frequency is lower than the first resonance frequency.

16. A hand-held telecommunication device capable of operating at multi-band frequencies, said hand-held telecommunication device comprises:

a housing including a front portion and a back cover;

a chassis disposed in the housing between the front portion and the back cover, wherein the chassis has a back side facing the back cover and an opposing front side having a ground plane; and an antenna structure comprising:

a first planar radiating element formed of a first electrically conducting area having a first resonance frequency, wherein the first planar radiating element has a grounding point connected to the ground plane, and a feed point for feeding adjacent to the grounding point;

a second planar radiating element formed of a second electrically conducting area having a second resonance frequency substantially lower than the first resonance frequency, wherein the second electrically conducting area has a grounding end connected to the first electrically conducting area adjacent to the grounding point of the first planar radiating element, and an open end surrounding at least two sides of the first electrically conducting area, leaving a gap between the second electrically conducting area and the surrounded sides of the first electrically conducting area, wherein the ground plane has a top edge, and wherein the open end has an extended portion adjacent to the top edge of the ground plane.

17. A hand-held telecommunication device capable of operating at multi-band frequencies, said hand-held telecommunication device comprises:

a housing including a front portion and a back cover;

a chassis disposed in the housing between the front portion and the back cover, wherein the chassis has a back side facing the back cover and an opposing front side having a ground plane; and an antenna structure comprising:

a first planar radiating element formed of a first electrically conducting area having a first resonance frequency, wherein the first planar radiating element has a grounding point connected to the ground plane, and a feed point for feeding adjacent to the grounding point;

a second planar radiating element formed of a second electrically conducting area having a second resonance frequency substantially lower than the first resonance frequency, wherein the second electrically conducting area has a grounding end connected to the first electrically conducting area adjacent to the grounding point of the first planar radiating element, and an open end surrounding at least two sides of the first electrically conducting area, leaving a gap between the second electrically conducting area and the surrounded sides of the first electrically conducting area, wherein the ground plane has a top edge adjacent to a top end of the housing, and wherein the open end has an extended portion adjacent to the top end of the housing and extended beyond the top edge of the ground plane.

18. A method of improving radiating efficiency and characteristics of a multi-band antenna structure in a hand-held telecommunication device, wherein the hand-held telecommunication device comprises:

a housing including a front portion and a back cover;

a chassis disposed in the housing between the front portion and the back cover, wherein the chassis has a back side facing the back cover and an opposing front side having a ground plane, and wherein the ground plane has a top edge located adjacent to a top section of the housing; and an antenna structure comprising:

at least two planar radiating elements, wherein the first planar radiating element is formed of a first electrically conducting area having a first resonance frequency, and wherein the first planar radiating element has a grounding point connected to the ground plane, and a feed point for feeding adjacent to the ground point; and the second planar radiating element is formed of a second electrically conducting area having a second resonance frequency substantially lower than the first resonance frequency, wherein the second electrically conducting area has a grounding end connected to the first electrically conducting area adjacent to the grounding point of the first planar radiating element, and an open end surrounding at least two sides of the first electrically conducting area, leaving a gap between the second electrically conducting area and the surrounded sides of the first electrically conducting area, and the open end has an extended portion adjacent to the top end of the housing, said method comprising the steps of:

disposing the ground plane away from the top end of the housing for providing a further gap between the top edge of the ground plane and the top end of the housing; and disposing the antenna on the chassis such that the extended portion of the open end of the second electrically conducting area is extended beyond the top edge of the ground plane over the further gap between the top edge of the ground plane and the top end of the housing.

19. The method of claim 18, wherein the antenna structure further includes a third radiating element formed of a third electrically conducting area adjacent to the second planar radiating element having a third resonance frequency generally higher than the first resonance frequency, wherein the third electrically conducting area has a further grounding point.

* * * * *